US011498105B2

(12) United States Patent
Jenzer et al.

(10) Patent No.: US 11,498,105 B2
(45) Date of Patent: Nov. 15, 2022

(54) METHOD FOR PRODUCING A ROLLED EDGE

(71) Applicant: ADVAL TECH HOLDING AG, Niederwangen (CH)

(72) Inventors: Beat Jenzer, Niederwangen (CH); Sandro Bertogg, Gümmenen (CH); Urs Graf, Bösingen (CH); Jürg Spieler, Hergiswil (CH)

(73) Assignee: ADVAL TECH HOLDING AG, Niederwangen (CH)

( * ) Notice: Subject to any disclaimer, the term of this patent is extended or adjusted under 35 U.S.C. 154(b) by 60 days.

(21) Appl. No.: 16/652,889

(22) PCT Filed: Sep. 27, 2018

(86) PCT No.: PCT/EP2018/076201

§ 371 (c)(1),
(2) Date: Apr. 1, 2020

(87) PCT Pub. No.: WO2019/068539

PCT Pub. Date: Apr. 11, 2019

(65) Prior Publication Data

US 2020/0246854 A1 Aug. 6, 2020

(30) Foreign Application Priority Data

Oct. 2, 2017 (EP) ..... 17194330

(51) Int. Cl.
*B21D 7/02* (2006.01)

(52) U.S. Cl.
CPC ..... *B21D 7/02* (2013.01)

(58) Field of Classification Search
CPC ..... B21D 7/02; B21D 19/06; B21D 19/12; B21D 51/2615
See application file for complete search history.

(56) References Cited

U.S. PATENT DOCUMENTS 4,113,133 A 9/1978 Berthet

FOREIGN PATENT DOCUMENTS

DE 20 2013 100 529 U1 4/2013
EP 1 372 880 A1 1/2004

OTHER PUBLICATIONS

International Search Report of PCT/EP2018/076201 dated Jan. 24, 2019 [PCT/ISA/210].

*Primary Examiner* — Teresa M Ekiert
(74) *Attorney, Agent, or Firm* — Sughrue Mion, PLLC

(57) ABSTRACT

The invention relates to a method for producing a rolled edge from a cylindrical edge portion (11) of a pipe. In the method, a starting zone (14) of the edge portion (11) is rolled by a forcibly controlled tool (30). A flanging die (21) then advances into the rolled edge portion (11) and flanges the rolled edge portion into a roll (12). The method according to the invention is characterized in that the starting zone (14) of the edge portion (11) is folded over by the tool (30), which comprises a folding die (37) and counterholder (34), at an angle (α) in the range from 75-105° from the axial direction (45) into a substantially radially peripheral flange (41). The invention further relates to elements, in particular in the forme of an aerosol dome, having such rolled edges.

25 Claims, 4 Drawing Sheets

Prior Art
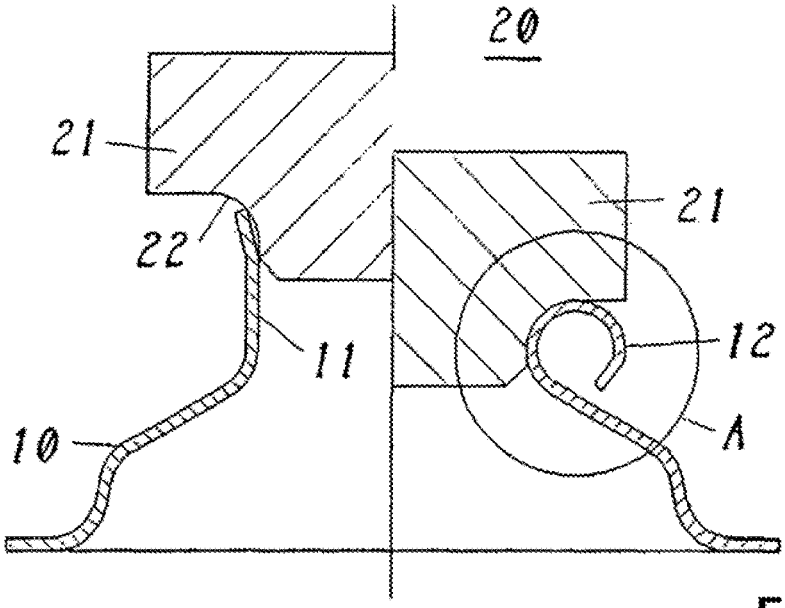
FIG. 1
FIG. 2a)
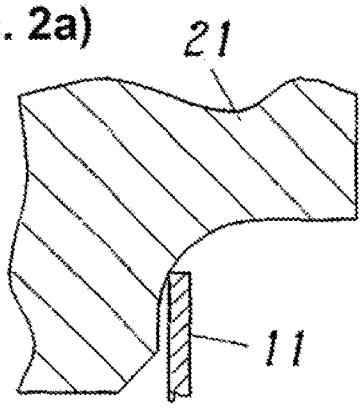
FIG. 2b)
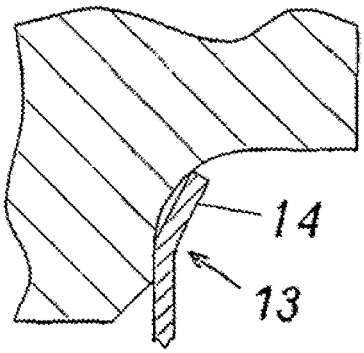
FIG. 2c)
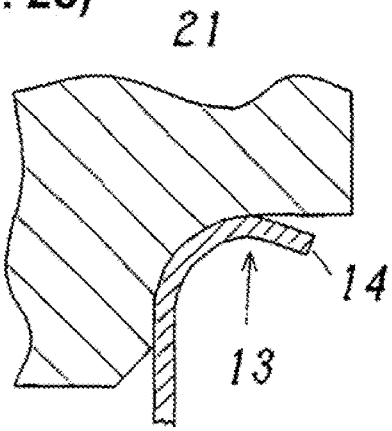
FIG. 2d)
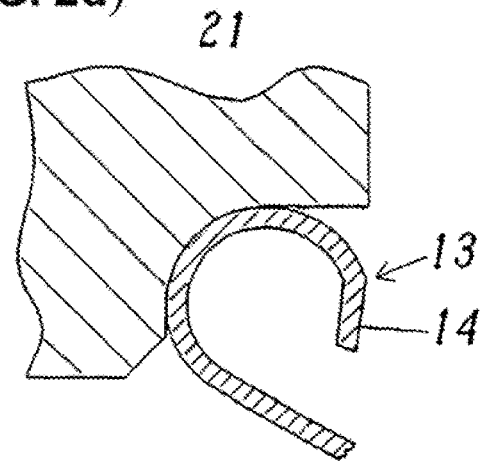

FIG. 2e) Prior Art

METHOD FOR PRODUCING A ROLLED EDGE

CROSS REFERENCE TO RELATED APPLICATIONS

This application is a National Stage of International Application No. PCT/EP2018/076201, filed Sep. 27, 2018, claiming priority to European Patent Application No. 17 194 330.1, filed Oct. 2, 2017.

TECHNICAL FIELD

The present invention relates to a method for producing a rolled edge from an edge portion of a pipe, during which a flanging die is advanced into the edge portion and flanges it into a roll.

Methods of this kind find application in the manufacture of so-called aerosol domes for spray bottles, and elsewhere, wherein a tubular portion of this dome is formed in just such a rolled edge to accommodate a valve plate. In particular, high demands are placed on the precision here, and thin metal sheets of only a few tenths of a millimeter thickness have to be used.

PRIOR ART

In the present-day manufacture of the rolled edge on the aerosol domes, a flanging die with a particular radius is advanced into a pipe portion previously produced on the aerosol dome by a drawing method and flanges the edge of this pipe portion into a roll. The shape and size of the rolled edge are largely determined by the geometry of the flanging die and its mentioned radius. In this forming process, however, the starting zone of the rolled edge generally does not have the desired radius, but instead a rather straight shape. A kind of bend is formed between the rather straight starting zone and the adjoining radially deformed zone. This effect is caused by the inherent stability of the sheet metal and is more pronounced as the sheet metal gets harder and thinner. Moreover, irregularities in the material and in the tooling have similar effects and on the whole cause nonuniform, uncontrolled deformations.

The above described situation shall be explained more closely with the aid of FIGS. 1, 2*a*)-2*e*) and 3.

FIG. 1 shows in a longitudinal section an aerosol dome 10 having a pipe portion 11 and a flanging die 21 with a radius 22 of a not otherwise depicted forming tool 20. The left side of FIG. 1 shows the starting condition with the as yet undeformed pipe portion 11 and the flanging die 21 in its starting position. The right side of FIG. 1 shows the flanging die 21 in its end position. During the movement of the die 21 between the start and end position, the pipe portion 11 becomes deformed (or at least its edge portion is so deformed, depending on the length of the pipe portion) along the radius 22 to form a roll 12.

FIGS. 2*a*)-2*e*) each show details of the rolling process in an enlarged cut-out view A of FIG. 1. As can be seen, during the transition from FIG. 2*a*) to FIG. 2*b*) forming a practically straight starting zone 14 there is produced the mentioned bend 13, which remains intact, unfavorably, in the further forming process per FIGS. 2*c*)-2*e*). In forming technology, the starting zone 14 constitutes an uncontrolled geometry zone. It results in a variable height H (see FIG. 2*e*) of the rolled edge 12 and thus also to an uncontrolled, irregular edge geometry 15, as shown in FIG. 3 in a partial view of the formed aerosol dome.

In order to solve this problem. EP-A-1 372 880 proposes structuring the process as indicated in FIGS. 4-6; in FIG. 4 (showing in a longitudinal section an aerosol dome with a pipe portion in a rolling tool in two positions, namely, still undeformed at left, and finally rolled at right), once again an aerosol dome having a pipe portion 11 is denoted as 10, but it is placed here in a rolling tool 30. This comprises a rolling die 31, with a radius 32, at least one hold-down 33, multiple counterholders 34, and a corresponding number of pushers 35. The counterholders 34 may be formed as four radially movable segments, which together bound off or release a circular opening. On the left side of FIG. 4 is shown the starting condition with the still undeformed pipe portion 11 and the rolling die 31 in its start position. However, the parts 33-35 are already in their end or functional position. They reach this position from a release position, shown by broken lines, in that at first the hold-down 33 together with the counterholders 34 move downward until striking against an annular edge 16 of the aerosol dome. The pushers 35 then travel downward as far as the hold-down 33. Being coupled by an inclined surface to the counterholders 34, they push the counterholders 34 radially inward as far as their end position for the embossing process, as shown. The right side of FIG. 4 shows the rolling die 31 in its end position. As the rolling die 31 moves between its start and end position, a starting portion 14 of the pipe portion 11 becomes rolled and is provided with the radius 32. After this, the rolling die 31 is again pulled back from the pipe portion, the pushers 35 travel upward, the counterholders 34 travel radially outward, the hold-down 33 travels upward and the aerosol dome 10 is thereby released.

As described above, the aerosol dome 10 or its pipe portion 11 can then be further formed according to the method already explained with the aid of FIGS. 1 and 2, wherein FIG. 5 shows a representation corresponding to FIG. 1. As can be seen however, the starting zone 14 of the pipe portion 11 already starting to be rolled in the start position shown at the left side nestles with form fitting against the radius 22 of the flanging die 21. For this, preferably the radius 22 of the flanging die 21 on the one hand and the radius 32 of the rolling die 31 also have the same dimension. In the further rolling with the flanging die 21, the starting zone 14 is given its controlled radius in FIG. 6, as shown in the detailed representation B of FIG. 5, having the finally rolled edge portion.

The problem with such methods according to the prior art, among other things, is that they cannot be performed, especially with starting material having great strength, without material stresses and associated cracks and breakage elongations. Furthermore, the rolled edge is found to be wavy, since the collar does not take on the flange radius.

From U.S. Pat. No. 4,113,133 there is known a method for producing the rolled edge on a pressure container, wherein the rolled edge extends outward from the container wall and has a circular segment portion of at least 180° in cross section through the container axis, into which the end portion of the rolled edge is introduced, the end portion being straight in the cross section through the container axis, which has a length that is larger than the radius of the circular segment portion, and forming an acute angle with the container axis toward the bottom of the pressure container. The method is characterized in that the edge is brought to the desired opening diameter, the end portion of the edge is bent outward in a straight line perpendicular to the container axis, the tooling producing a free forming so that the portion is not supported at the bottom, and it is then bent downward while forming an acute angle with the container wall, and the edge is then rolled to form the circular segment portion.

From DE 20 2013 100 529 U1 there is known a flanging machine for cans, comprising a container and a lid; wherein the flanging machine has at least one flanging device, which rolls an already folded-over edge radially from the outside and is designed to join together the container and the lid by a flanging process. The tooling comprises a roller, engaging radially from the outside, which is designed to carry out the flanging process at the edges of the lid and the container, the method is characterized in that the (at least one) flanging device comprises a pneumatic actuator, which is designed to move the roller so that it is brought into contact with the can and performs the flanging process.

PRESENTATION OF THE INVENTION

The subject matter of the present invention is accordingly a method for producing a rolled edge from a cylindrical edge portion of a pipe, in which method a starting zone of the edge portion is rolled by a forcibly controlled tool or better folded over into a straight flange and then a flanging die is advanced into the rolled or better folded over edge portion and flanges this into a roll. The method takes place in preferably only these two steps, i.e., the cylindrical edge portion, which may be optionally previously treated (for example, surface treatment, adjusting of the concentricity, etc.) but is introduced in the process as just such a cylindrical edge portion, is machined in precisely these two steps, namely, it is folded over in the first step and then this folded-over edge is rolled in the second step. Preferably, no further steps are provided. Accordingly, the method preferably involves only these two steps. Hence, it is preferably a two-step method for making a rolled edge from a cylindrical edge portion of a pipe, which method consists of the mentioned first step and the mentioned second step, in order to provide the final rolled edge intended for its use.

The method is thereby characterized in that in the mentioned first step of the folding over, the starting zone of the edge portion is folded over by the tool, comprising a folding die, which is introduced preferably axially in the first step at least partly into the opening of the edge portion, and preferably a counterholder, at an angle ($\alpha$) in the range of 75-105° from the axial direction into a substantially radial peripheral flange. The angle $\alpha$ of this flange is preferably in the range of 80-100°, preferably in the range of 85-95°. The folding die has a plane bearing surface, inclined with respect to the axis of the edge portion according to the mentioned folding angle, and the counterholder has a likewise plane abutting surface, running substantially parallel to it. If the folding die is advanced from above into the cylindrical edge portion, the abutting surface of the counterholder thus supports the folded-over portion at the bottom and thus enables a controlled process with small bending radii, even in the case of hard materials, thanks to the supported process control.

The problem with the above described, totally original method was that an aesthetically unsatisfactory edge resulted at the end of the rolled edge. It was possible to largely eliminate this problem with the method according to EP-A-1 372 880. Yet it was found that both methods cause problems, especially given the present-day demand for harder and/or thinner sheet metal as the starting material, insofar as one indeed wishes to employ only two steps for the entire rolling of the edge, and wishes to avoid further intermediate processing steps, which bring with them additional complications and additional costs. Especially when using for example tinplate of type TH520 or TH500 (or materials with even higher yield strength and/or tensile strength), cracks are produced as a result of the material stresses caused by the lower breakage elongation in the two-step method of the prior art. Furthermore, the edge becomes wavy, since the collar does not take on the flanging radius.

In order to use materials with the mentioned higher yield strength and/or tensile strength, a supported forming rather than a free forming (with only one die) is preferably used for the first step of the folding over, for example by contrast with the method described in U.S. Pat. No. 4,113,133, which cannot work with such hard materials, that is, the edge is folded over at an angle ($\alpha$) with a tooling comprised of a folding die and a counterholder. A free forming does not allow any tilting with small radii in the case of these materials.

Surprisingly, it has now been discovered that these problems can be solved, especially in the context of the two-step method, and therefore the mentioned hard materials and even harder materials can be used without the mentioned problems, if the starting region of the pipe is not rolled, but rather folded over substantially by 90°. This stabilizes the end of the collar, and the wave formation by anisotropy. Furthermore, this relieves the starting region of the collar from the material stresses caused by the preparation process.

A preferred embodiment of the method is characterized in that the bending radius r between the peripheral flange and the adjoining axial portion is less than twice the material thickness s of the cylindrical edge portion. In other words, the length of the leg of the 90° bend is preferably defined in a ratio relative to the material thickness.

Further preferably, the bending radius r is in the range of 0.5-1.5 times, especially preferably in the range of 0.75-1.25 times the material thickness (s) of the cylindrical edge portion.

Another preferred embodiment is characterized in that the radial length q of the flange is in the range of 2-5 times, preferably in the range of 3-4 times or 3-3.5 times the material thickness (s) of the cylindrical edge portion.

Preferably, the 90° flange which is initially created is hidden somewhat in the interior of the roll during the flanging. Accordingly, the method according to another preferred embodiment is characterized in that the substantially linear portion of the flange during the rolling which follows the folding over is placed by the flanging die in the interior of the roll, and is preferably directed in substantially radial direction into the roll.

The material thickness of the edge portion is preferably in the range of 0.05-1 mm, preferably in the range of 0.15-0.4 mm, especially preferably in the range of 0.18-0.34 mm.

The material of the edge portion is typically sheet steel, preferably tinplate.

Further preferably, the material used for the edge portion is sheet steel with a yield strength (determined per EN 10202:2001, especially chapter 8.2, and the measurement method of DIN EN 10002-1:2001) of at least 500 MPa, preferably at least 520 MPa, especially preferably at least 550 MPa.

According to a preferred embodiment, the material used for the edge portion can be sheet steel with a tensile strength (determined per EN 10202:2001, especially chapter 8.2, and the measurement method of DIN EN 10002-1:2001) of at least 500 MPa, preferably at least 550 MPa, especially preferably at least 575 MPa.

Typically, the material of the edge portion is tinplate of type TH520 (material number 1.0384), TH550 (material number 1.0373), TH580 (material number 1.0382), TH620 (material number 1.0374), or the corresponding TS types, each time according to DIN EN 10202: 2001. Alternatively, formulated by type DR8, DR8, DR8.5, or DR9, each time according to AISI/ASTM 623. The corresponding compositions and properties of these materials are defined in the cited standards; the corresponding disclosure in the cited standards is explicitly included in the content of the present disclosure for the definition of the materials specifically mentioned here.

In order for the folded-over edge to also be effectively rolled afterwards, the flanging die preferably has a wrap angle of at least 100°, preferably at least 120°.

The tool normally comprises a plurality of outer counterholders, which are radially adjustable in regard to the pipe axis, as well as a folding die, and the rolling is done in the following steps:

- moving the outer counterholders radially inward until striking against the pipe portion,
- advancing the folding die into the pipe portion with folding over of its starting zone,
- removing the folding die from the pipe portion,
- moving the outer counterholders radially outward with axial releasing of the pipe portion.

Thereby 3, 4, 5, or 6, preferably 4, outer counterholders can be provided, distributed about the circumference, each of them having a radial arm and radially inward situated clamping areas, which substantially encircle and enclose the axial portion.

The rolled edge is typically placed on a tubular portion of an aerosol dome for spray cans to accommodate a valve plate, wherein optionally additional forming steps, especially for the preparation of the fastening to the spray can, can be performed in parallel or in addition to the steps discussed above.

Preferably, the folding die and the counterholder surround the edge portion with form fitting during the folding over.

Further, the present invention relates to the use of such a method for making a rolled edge, especially for making an aerosol dome with such a rolled edge for a spray can.

Lastly, the present invention relates to a rolled edge, especially as part of an aerosol dome for a spray can, produced by a method as presented above, or a spray can having such a rolled edge.

Further embodiments are indicated in the dependent claims.

BRIEF DESCRIPTION OF THE DRAWINGS

Preferred embodiments of the invention are described in the following with the aid of the drawings, serving only for explanation and not to be understood as limitations. The drawings show:

FIG. 1-6 the already explained figures to illustrate the relations in the prior art;

DESCRIPTION OF PREFERRED EMBODIMENTS

FIGS. 7-11 show, in various representations and in different steps of the method, the newly proposed method for producing a rolled edge, now also possibly using harder materials than the previously possible ones.

Figure 3:
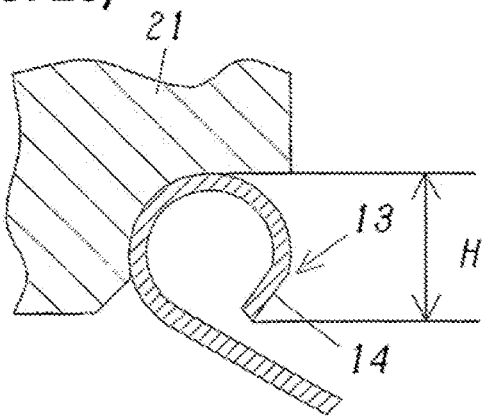
Figure 3:
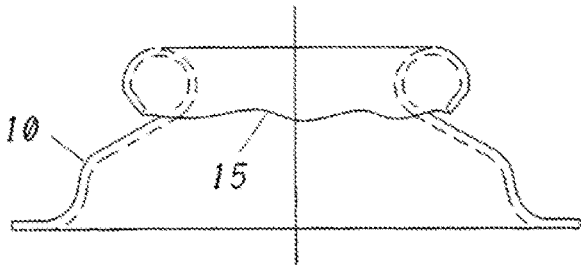
Figure 4:
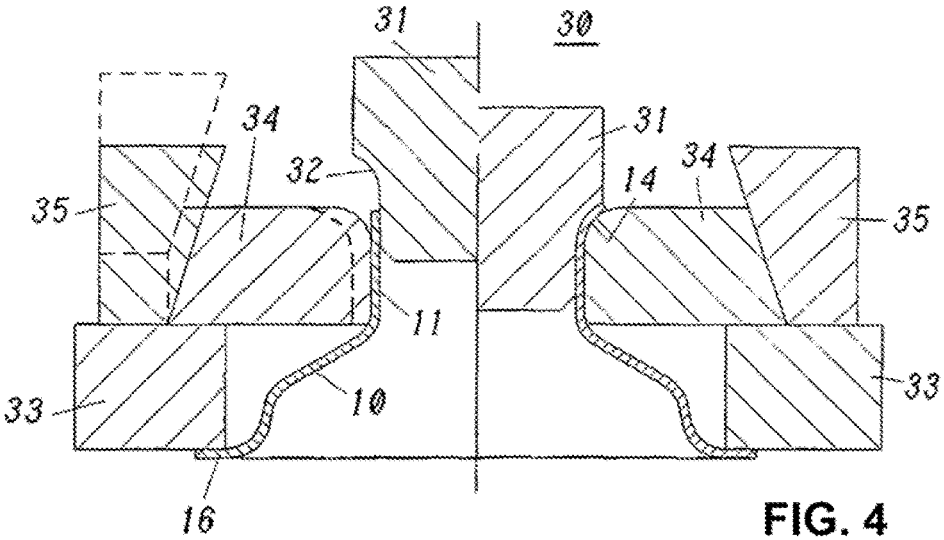
Figure 5:
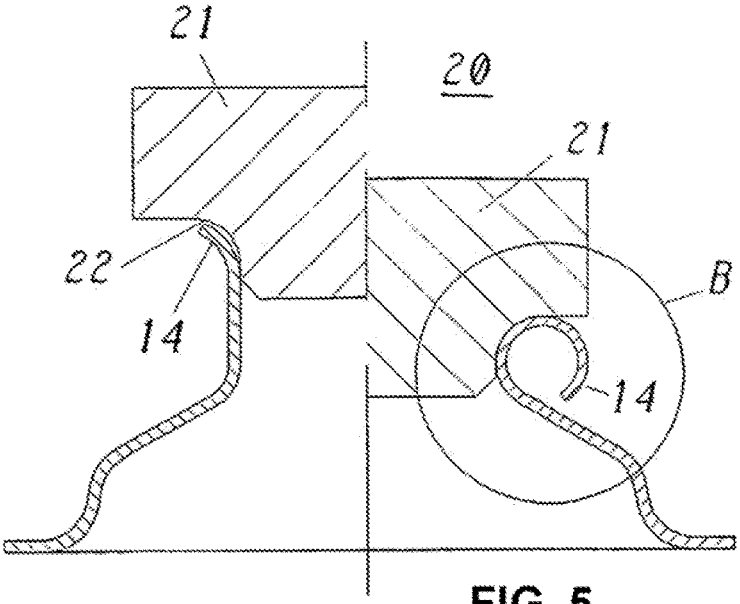
Figure 6:
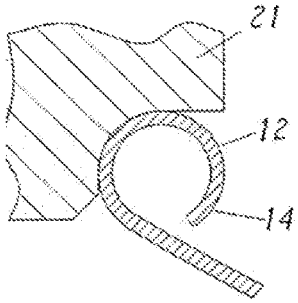
Figure 7:
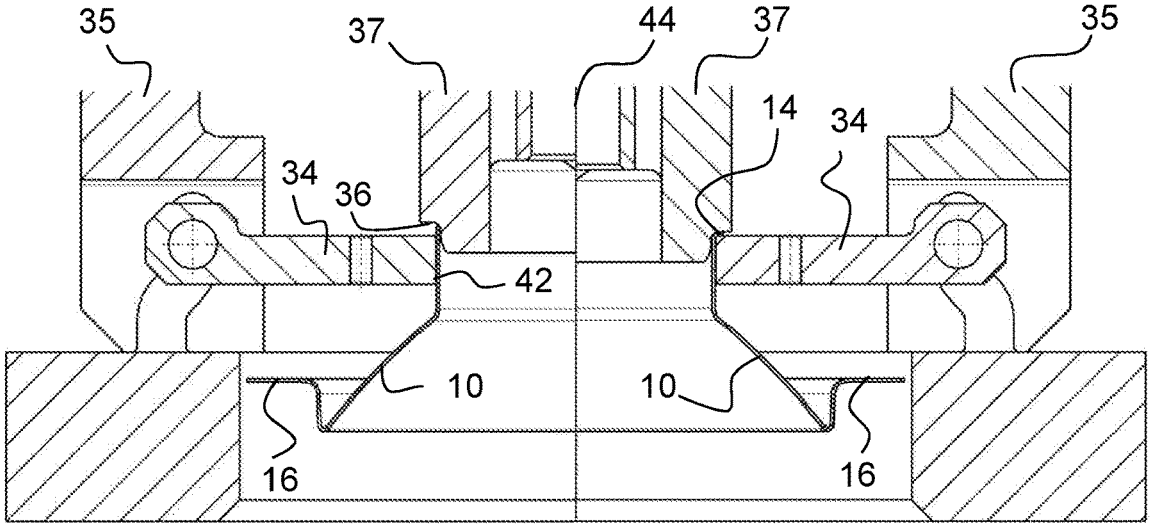
FIG. 7 a representation of an aerosol dome and a folding die as well as pusher and counterholder in two positions, namely, still undeformed at left and folded over at right, i.e., the aerosol dome having a folded-over starting zone.

FIG. 7 shows the step of folding over the starting zone 14 in the tooling, with tooling still open at the left side, and at the right side in the condition of the tooling with the edge folded over into a peripheral flange 41.

Figure 8:
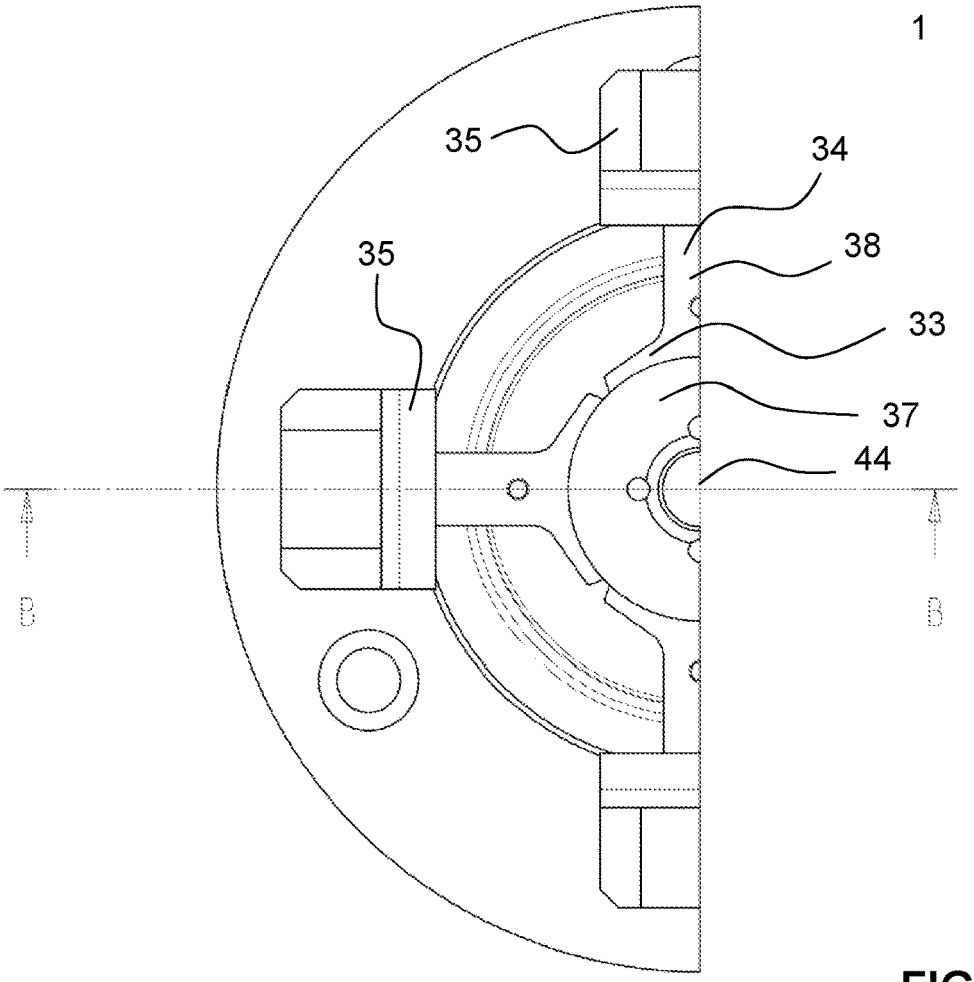
FIG. 8 a plan view of the folding die.

As can be seen at the left side, the aerosol dome 10 and the axial portion 42 have respective counterholder elements 34 at the side, around the circumference, and from above a folding die 37 with a narrow radius 36 is introduced into the opening along the axis 44. The starting region 14 is folded over at a right angle and forming a relatively sharp edge, basically by a right angle or roughly 90°, as can be seen on the right side in FIG. 7. FIG. 8 shows one possible tooling to perform this first operation of creating the rolled edge in a plan view. It can be seen that there are a total of 4 pushers 35, which control the counterholders 34. The counterholders 34 each have a radial arm 38, relative to the tooling axis 44, and regions 39 encircling and engaging the axial portion 42 of the workpiece by somewhat less than 90°.

Figure 9:
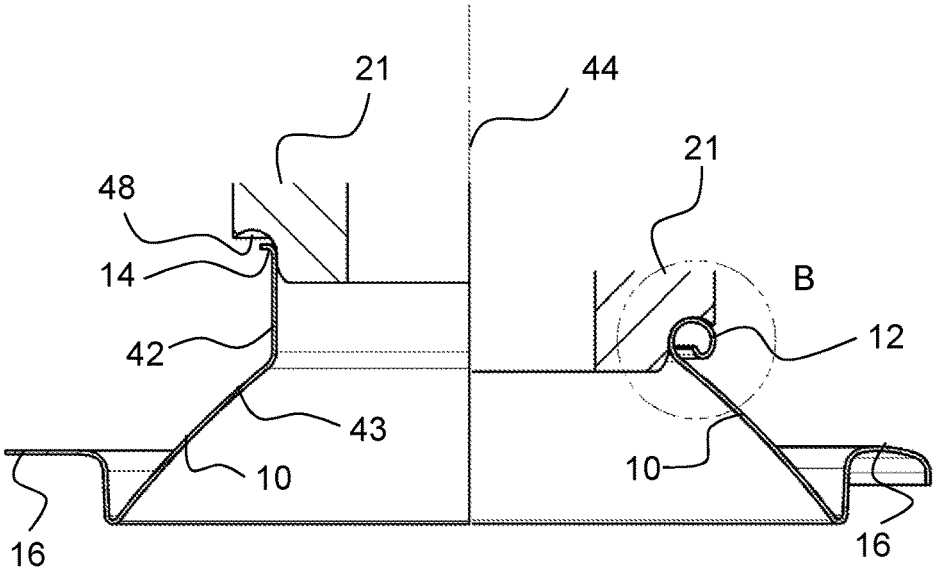
FIG. 9 a representation of an aerosol dome in the rolling tool with flanging die, but the aerosol dome already having a folded-over starting zone.

In the next step, the actual rolled edge is created, which is shown in FIG. 9. Once again, the condition with the tooling still open is shown at the left side, that is, in a condition where the flanging die 21 has been introduced into the opening of the prepared dome, but has not yet formed the edge region. The flanging die 21 has a relatively large wrap angle 48 of around 120°. Further tooling elements, especially counterholders, can likewise be provided in this step, but are not mandatory. The flanging die 21 then advances axially into the opening and now rolls the axial portion 42 into the actual roll 12.

Figure 10:
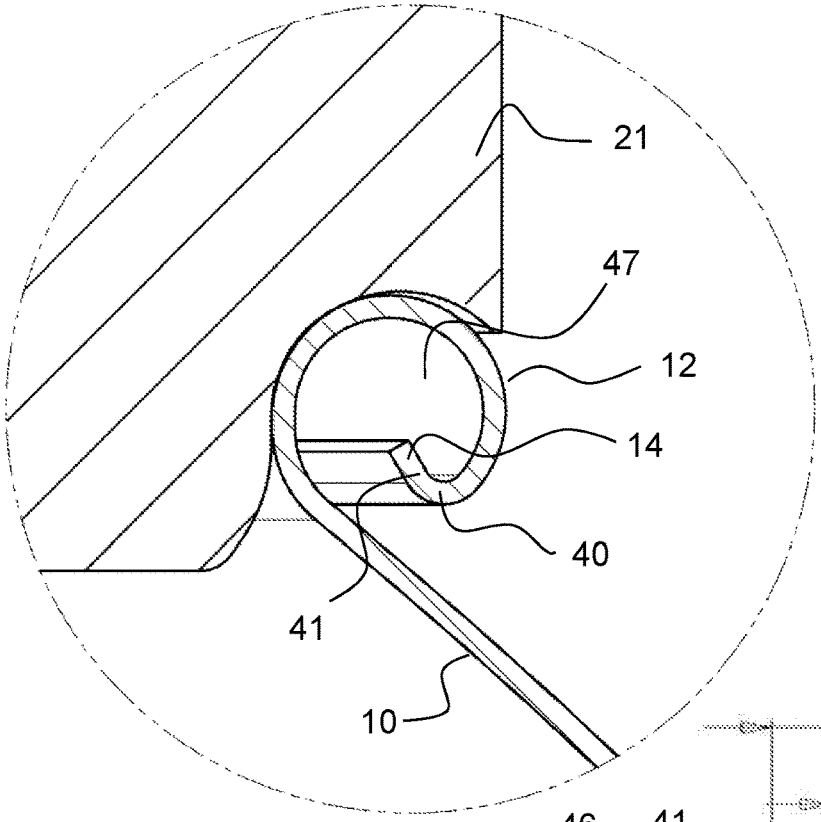
FIG. 10 in a detailed large cut-out view per B in FIG. 9, a finally rolled rolled edge according to the invention.

As can be seen in the detailed cut-out of FIG. 10, the folded-over starting zone remains basically unchanged. The almost linear folded-over region 41 and the sharp bend 40 remain basically intact, but are no hindrance, since the edge is rolled so much to form the roll 12 that the almost linear region 41 points more or less into the interior 47 of the roll 12. Thus, no disturbing or especially aesthetically problematical effects result, and also the safety is entirely assured, since an optionally sharp edge is moved into the interior of the roll.

Figure 11:
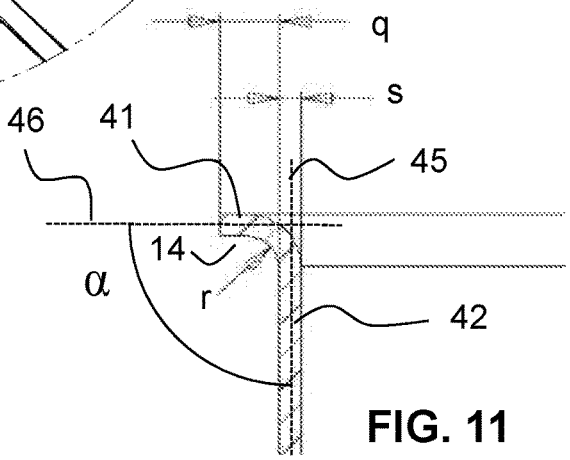
FIG. 11 a detailed representation of the folded-over portion prior to the treatment with the flanging die.

For the functioning of the process, the material thickness and radius as well as the bending length are advantageously specifically attuned to each other. The individual parameters for this are shown in FIG. 11. On the one hand the folding angle $\alpha$, on the other hand the bending length q, that is, the radial extension of the flange, as well as the material thickness s. These variables are each given in terms of the axial portion 42, the almost linear region 41 and the axial direction in the region of the axial portion 42 or the radial direction 46, or—when not exactly equal to 90°—the substantially radial direction (46) of the folded-over region 41.

| LIST OF REFERENCE SYMBOLS | |
|---|---|
| 10 | Aerosol dome |
| 11 | Pipe or edge portion of aerosol dome |
| 12 | Roll |

-continued

| LIST OF REFERENCE SYMBOLS | |
|---|---|
| 13 | Bend |
| 14 | Starting zone |
| 15 | Edge geometry |
| 16 | Annular edge |
| 20 | Forming tool |
| 21 | Flanging die |
| 22 | Radius at flanging die |
| 30 | Rolling tool |
| 31 | Rolling die |
| 31 | Radius at rolling die |
| 32 | Hold-down |
| 34 | Counterholder |
| 35 | Pusher |
| 36 | Radius at folding die |
| 37 | Folding die |
| 38 | Radial arm of 34 |
| 39 | Clamping area of 34 |
| 40 | Sharp bend in 12 |
| 41 | Almost-linear region of 14 |
| 42 | Axial portion |
| 43 | Dome portion |
| 44 | Axis of symmetry |
| 45 | Axial direction in region 42 |
| 46 | Direction of folded-over region 41 |
| 47 | Interior of 12 |
| 48 | Wrap angle of 21 |
| s | Material thickness |
| q | Bending length |
| r | Bending radius |
| α | Folding angle |

The invention claimed is:

1. A method for producing a rolled edge from a cylindrical edge portion of a pipe, which method consists of the following steps:

a first step of folding over a starting zone of said cylindrical edge portion by a first, forcibly controlled tool, comprising a folding die and counterholder, to form a substantially radial peripheral flange, wherein the starting zone of said cylindrical edge portion is folded over by said folding die and counterholder at an angle α in a range of 75-105° from an axial direction into said substantially radial peripheral flange, and a second step with a second tool comprising a flanging die and advancing said flanging die into said substantially radial peripheral flange and rolling said substantially radial peripheral flange into said rolled edge.

2. The method as claimed in claim 1, wherein the bending radius between said substantially radial peripheral flange and an adjoining axial portion is less than twice a material thickness (s) of said cylindrical edge portion.

3. The method as claimed in claim 1, wherein a radial length of said substantially radial peripheral flange is in a range of 2-5 times a material thickness of said cylindrical edge portion.

4. The method as claimed in claim 1, wherein a substantially linear portion of said substantially radial peripheral flange during the rolling in said second step, which follows the folding over in said first step, is placed by said flanging die in an interior of the rolled edge.

5. The method as claimed in claim 1, wherein the angle α is in the range of 80-100°.

6. The method as claimed in claim 1, wherein a material thickness of said cylindrical edge portion is in a range of 0.1-1 mm.

7. The method as claimed in claim 1, wherein the material of said cylindrical edge portion is tinplate.

8. The method as claimed in claim 1, wherein the material of said cylindrical edge portion is sheet steel with a yield strength, determined per DIN EN 10002-1:2001, of at least 500 MPa, and/or with a tensile strength, determined per DIN EN 10002-1:2001, of at least 500 MPa.

9. The method as claimed in claim 1, wherein the material of said cylindrical edge portion is sheet steel.

10. The method as claimed in claim 1, wherein said flanging die has a wrap angle of at least 100°.

11. The method as claimed in claim 1, wherein said second tool for the second step comprises a plurality of outer second tool counterholders, which are radially adjustable in regard to the pipe axis, as well as said folding die, and wherein the rolling in the second step involves the following phases:

moving said outer second tool counterholders radially inward until striking against a pipe portion, advancing said folding die into said pipe portion with folding over of its starting zone, removing said folding die from said pipe portion, and moving said second tool outer counterholders radially outward with axial releasing of said pipe portion.

12. The method as claimed in claim 1, wherein the rolled edge is placed on a tubular portion of an aerosol dome for spray cans to accommodate a valve plate.

13. A method for making part of an aerosol dome for a spray can comprising:

a method for producing a rolled edge from a cylindrical edge portion of a pipe as claimed in claim 1.

14. The method as claimed in claim 13, wherein the folding die and the counterholder in the first step surround the edge portion with form fitting.

15. The method as claimed in claim 1, wherein a bending radius between the peripheral flange and an adjoining axial portion is in a range of 0.5-1.5 times a material thickness of the cylindrical edge portion.

16. The method as claimed in claim 1, wherein a bending radius between the peripheral flange and an adjoining axial portion is in a range of 0.75-1.25 times a material thickness of the cylindrical edge portion.

17. The method as claimed in claim 1, wherein a radial length of the flange is in a range of 3-4 times a material thickness of the cylindrical edge portion.

18. The method as claimed in claim 1, wherein a substantially linear portion of the flange during the rolling in the second step, which follows the folding over in the second step, is placed by the flanging die in the interior of said rolled edge, and is directed in substantially radial direction into said rolled edge.

19. The method as claimed in claim 1, wherein the angle α is in the range of 85-95°.

20. The method as claimed in claim 1, wherein the material thickness of the edge portion is in the range of 0.15-0.4 mm.

21. The method as claimed in claim 1, wherein the material thickness of the edge portion is in the range of 0.18-0.34 mm.

22. The method as claimed in claim 8, wherein the material of the edge portion is sheet steel with a yield strength, determined per DIN EN 10002-1:2001, of at least 550 MPa, and/or with a tensile strength, determined per DIN EN 10002-1:2001, of at least 575 MPa.

23. The method as claimed in claim 1, wherein the material of the edge portion is tinplate of type TH520, material number 1.0384; TH550, material number 1.0373; TH580, material number 1.0382; TH620, material number 1.0374, or the corresponding TS types, each time according to DIN EN 10202: 2001, and/or DR8, DR8, DR8.5, or DR9, each time according to AISI/ASTM 623.

24. The method as claimed in claim 1, wherein the flanging die has a wrap angle of at least 120°.

25. The method as claimed in claim 1, wherein said second tool of the second step comprises 3, 4, 5 or 6 second tool outer counterholders, which are radially adjustable in regard to a pipe axis, as well as said folding die, and wherein the rolling involves the following phases:

moving the second tool outer counterholders radially inward until striking against a pipe portion, advancing said folding die into the pipe portion with folding over of its starting zone, removing said folding die from the pipe portion, and moving said second tool outer counterholders radially outward with axial releasing of the pipe portion, and wherein said second tool outer counterholders are provided, distributed about the circumference, each of them having a radial arm and radially inward situated clamping areas, which substantially encircle and enclose the axial portion.

* * * * *